US007226210B2

(12) United States Patent
Moon

(10) Patent No.: US 7,226,210 B2
(45) Date of Patent: Jun. 5, 2007

(54) SYNTHETIC RESIN BAG FOR GRAIN OR FEED

(76) Inventor: Byung Jin Moon, 988-2, Youngtong-Dong, Paldal-Gu, Suwon (KR)

( * ) Notice: Subject to any disclaimer, the term of this patent is extended or adjusted under 35 U.S.C. 154(b) by 546 days.

(21) Appl. No.: 10/763,685

(22) Filed: Jan. 23, 2004

(65) Prior Publication Data

US 2005/0084185 A1 Apr. 21, 2005

(30) Foreign Application Priority Data

Oct. 15, 2003 (KR) ..... 10-2003-0032327

(51) Int. Cl.
*B65D 30/04* (2006.01)
*B65D 30/08* (2006.01)
*B29D 22/00* (2006.01)

(52) U.S. Cl. ..... 383/117; 383/116; 428/35.7; 428/36.2

(58) Field of Classification Search ..... 383/116–117, 383/109, 105, 32; 428/36.2, 35.7
See application file for complete search history.

(56) References Cited

U.S. PATENT DOCUMENTS 3,645,822 A * 2/1972 Widiger et al. ..... 156/243
3,784,085 A * 1/1974 Kilgore ..... 383/113
4,788,088 A * 11/1988 Kohl ..... 428/34.5
6,203,867 B1 * 3/2001 Derkach et al. ..... 428/35.2
6,534,137 B1 * 3/2003 Vadhar ..... 428/34.9
2003/0031388 A1 * 2/2003 Gipson et al. ..... 383/64
2004/0191438 A1 * 9/2004 Cosentino et al. ..... 428/34.3

* cited by examiner

*Primary Examiner*—Jes F. Pascua
(74) *Attorney, Agent, or Firm*—Jordan and Hamburg LLP

(57) ABSTRACT

A synthetic resin bag is used for storing grain or animal feed. The bag includes an inner layer made of polypropylene textile woven in gauze, a coating layer attached to an inside surface of the inner layer, and an outer layer attached to an outside surface of the inner layer. Attaching between the layers is made by polypropylene resin applied thereto. The coating layer is made of high-density polyethylene film, and the outer layer is made of oriented polypropylene film mixed with non-slip material for raising coefficient of friction of the outer layer to 0.5 or more. Also, the outer layer has a printed inside layer. The bag allows inhibiting penetration of moisture in the air and preventing absorption or leakage of fat or oil in contents. Also, the bag is prevented from slipping and falling when stacked or conveyed.

1 Claim, 3 Drawing Sheets

RELATED ART

SYNTHETIC RESIN BAG FOR GRAIN OR FEED

BACKGROUND OF THE INVENTION

1. Field of the Invention

The present invention relates generally to a synthetic resin bag. More particularly, the present invention relates to a bag used for packing and storing grain or animal feed, especially powdered feed, feed containing fish oil of high permeation, feed containing much fat and moisture.

2. Description of the Related Art

It is well known that a burlap bag is used chiefly for carrying or storing items, for example, feed for domestic animals such as dog, chicken, cat and fish, or grain such as rice, barley, wheat and corn. In the past, a storage bag for grain or feed was made mainly of paper. The paper bag is, however, easily damaged in use by water or moisture. Furthermore, since the paper bag is not waterproof, contents of the bag can be badly changed in quality or easily lose their freshness by water penetrated into the paper bag. Additionally, in case of packing feed full of fat or oil, such fat or oil is unfavorably absorbed into paper.

A later paper bag is therefore reinforced with additional agents to prevent penetration by water and absorption of fat or oil. This type of a paper bag is illustrated in FIG. 1. Referring to FIG. 1, a paper bag 100 is composed of a dual paper structure, i.e., an outer paper layer 102 and an inner paper layer 103. In order to reinforce the paper layers 102 and 103, a layer 104 of polyethylene (PE) resin coats the inner layer 103. Also, a printed portion P partially covers the outer layer 102. The printed portion P is a set of certain figures or words directly printed on the outer layer 102, or alternatively a synthetic resin film printed with figures or words and adhering to the outer layer 102.

Upper and lower ends of the paper bag 100 are fastened by stitching, thereby forming sealing portions 105 and 105'. The upper sealing portion 105' has a stitching thread 106 and an unstitching thread 107. The unstitching thread 107 facilitates the opening of the bag 100.

Unfortunately, the above-described conventional paper bag 100 has some drawbacks. First, since the outer and inner paper layers 102 and 103, and the PE coating layer 104 are different in material, the paper bag 100 is difficult to recycle and cost-ineffective. Furthermore, since the outer paper layer 103 is still exposed to a damp environment, the strength of the paper bag 100 tends toward lowering over time by moisture in the air. This often causes a damage of the paper bag 100 while packed or conveyed. Additionally, the conventional paper bag 100 is prone to slip and fall due to a low sliding friction while stacked.

Moreover, if powdered feed is packed in the paper bag 100, powdered feed is apt to solidify by exposure to the ventilation of air. To solve such a problem, there is a case where the following steps are added, namely, inserting a vinyl bag into the paper bag, putting powdered feed in the vinyl bag, and tying up the upper end of the vinyl bag with a string. This solution, however, leads to the increases of manufacturing cost and working hours.

SUMMARY OF THE INVENTION

It is, therefore, an object of the present invention to provide an improved bag, which can inhibit penetration of water or moisture in the air and absorption of fat or oil in contents, thus preventing spoilage of contents, keeping freshness of contents, and increasing strength of the bag.

Another object of the present invention is to provide an improved bag, which is designed to prevent slipping and falling when stacked or conveyed, thereby allowing reliable stack and conveyance.

Still another object of the present invention is to provide an improved bag, which permits clear true-to-life color print thereon.

Still another object of the present invention is to provide an improved bag, which is capable of recycling and is cost-effective.

According to one aspect of the present invention, a bag includes an inner layer made of polypropylene textile woven in gauze, a coating layer attached to an inside surface of the inner layer by using polypropylene resin applied thereto, and an outer layer attached to an outside surface of the inner layer by using polypropylene resin applied thereto. The coating layer is made of high-density polyethylene film, and the outer layer is made of oriented polypropylene film mixed with non-slip material for raising coefficient of friction of the outer layer to 0.5 or more. Also, the outer layer has a printed inside layer.

DETAILED DESCRIPTION OF THE INVENTION

The present invention now will be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this disclosure will be thorough and complete, and will fully convey the scope of the invention to those skilled in the art.

Figure 1:
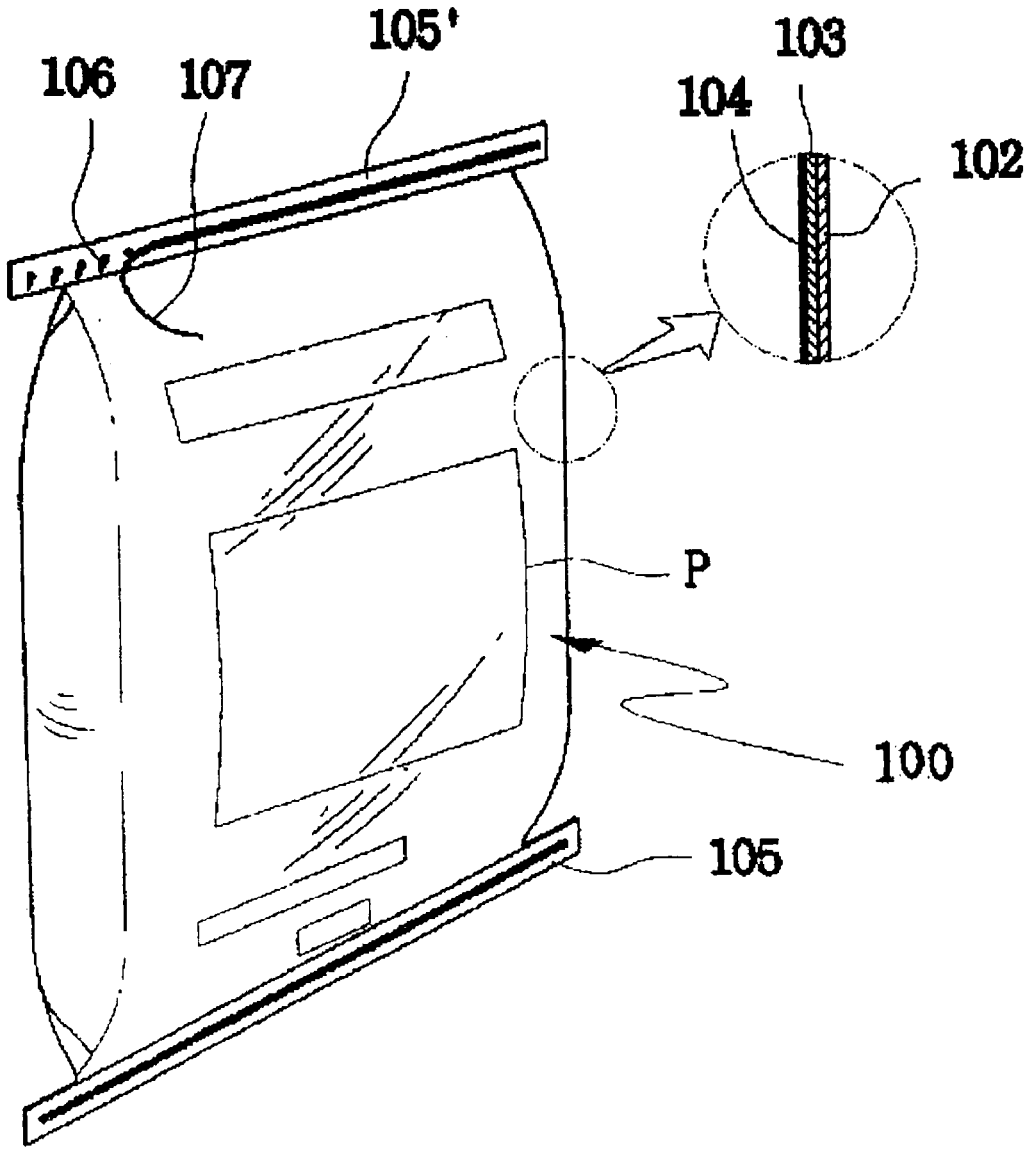
FIG. 1 is a perspective view of a conventional bag.
Figure 2:
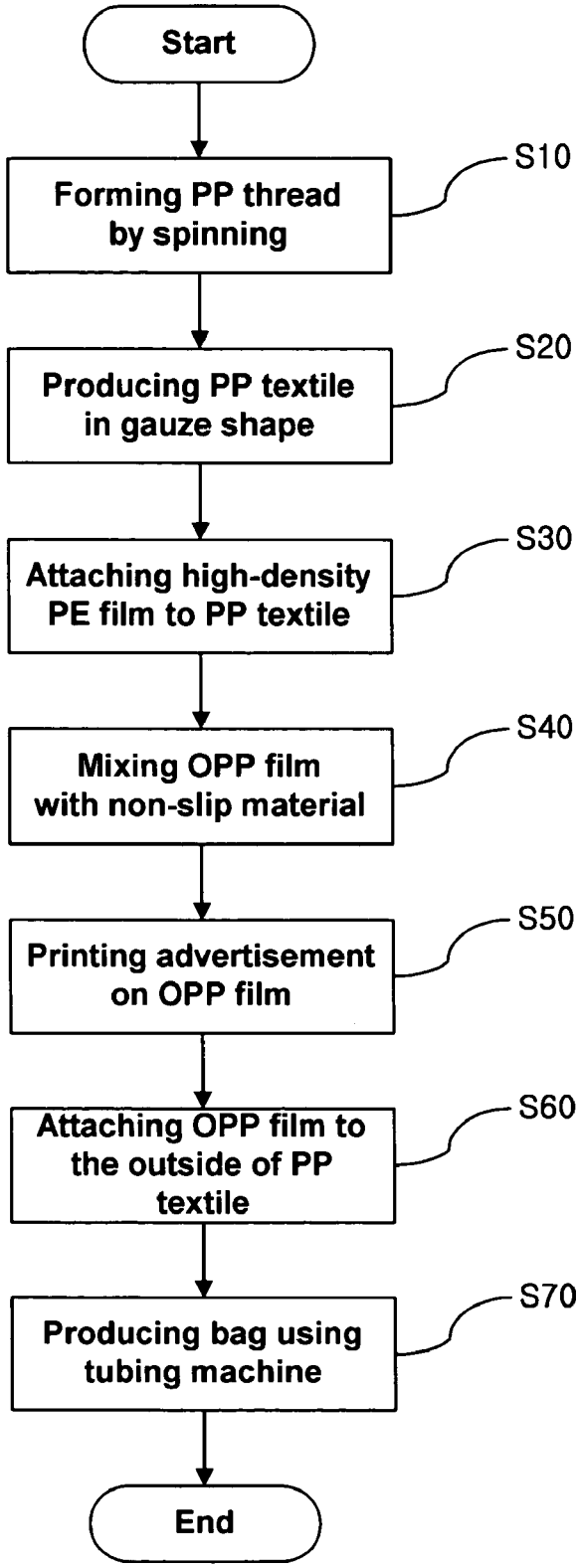
FIG. 2 is a flow chart schematically showing a process of fabricating a bag in accordance with one embodiment of the present invention.
Figure 3:
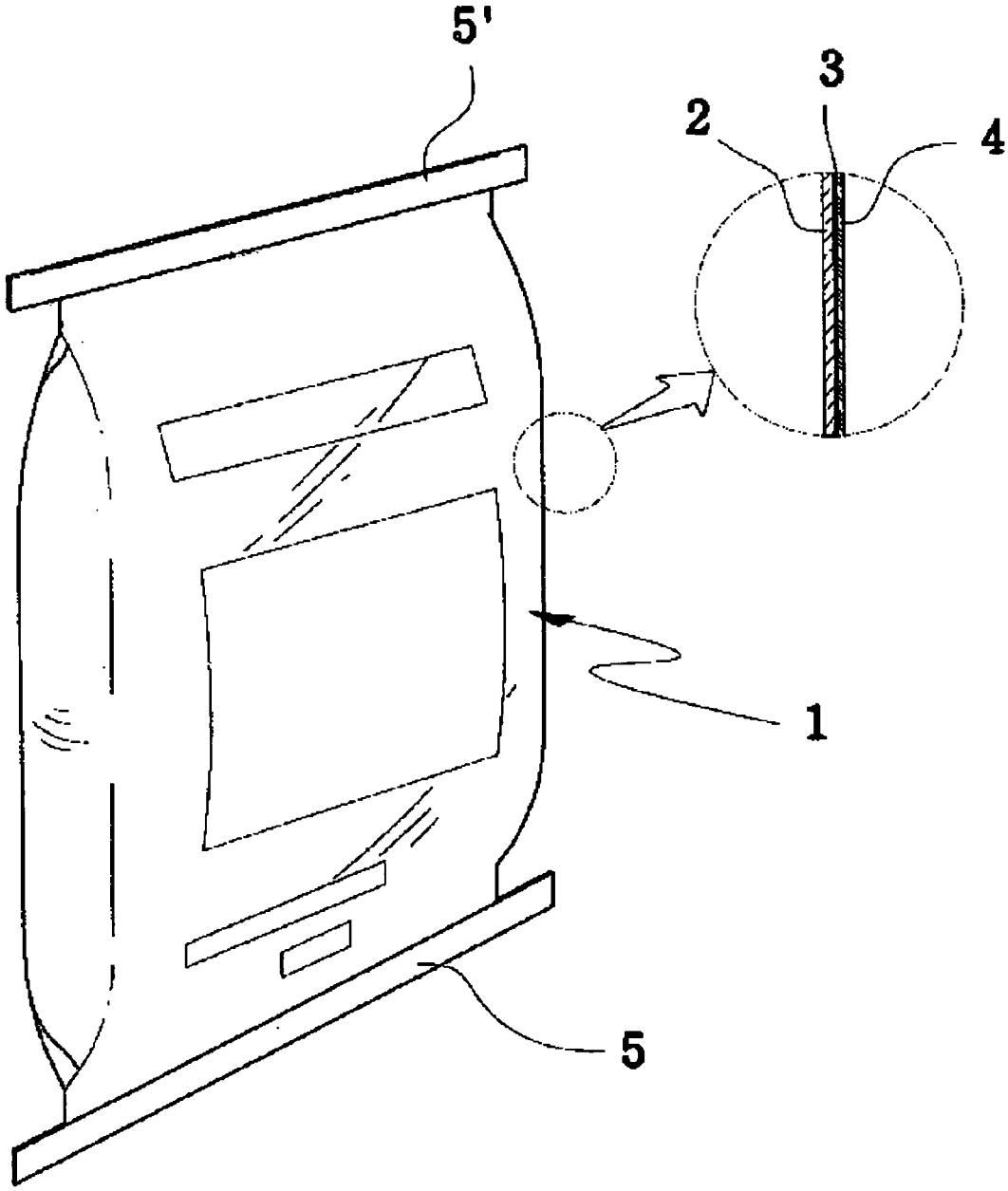
FIG. 3 is a perspective view of a bag in accordance with one embodiment of the present invention.

FIG. 2 schematically shows, in a flow chart, a process of fabricating a bag in accordance with one embodiment of the present invention, and FIG. 3 shows, in a perspective view, a bag in accordance with one embodiment of the present invention.

Referring to FIGS. 2 and 3, a bag 1 includes an inner coating layer 2, an inner base layer 3, and an outer layer 4.

The inner base layer 3 is preferably made of polypropylene (PP) textile in the following manner. First, PP resin is melt and PP thread is formed therefrom by spinning (step S10). Next, the PP thread is woven in gauze shape to produce the PP textile (step S20). Using PP resin for the inner base layer 3 increases the bending strength of the bag 1.

The inner coating layer 2 is preferably made of high-density polyethylene (PE) film and covers the inside surface of the inner base layer 3. In the fabrication, the high-density PE film for the coating layer 2 is attached to the inside of the PP textile for the base layer 3 by using PP resin applied thereto (step S30). Using high-density PE resin for the coating layer 2 not only facilitates thermal adhesion for sealing the bag 1, but also prevents absorption or leakage of fat or oil in contents.

The outer layer 4 is preferably made of oriented polypropylene (OPP) film mixed with non-slip material and covers the outside surface of the inner base layer 3. In the fabrication, the OPP film is mixed with non-slip material to raise the coefficient of friction thereof (step S40). Using non-slip material raises the coefficient of friction of the outer layer 4 to 0.5 or more, preferably, 0.7 or more, thereby preventing the bag 1 from slipping and falling when stacked or conveyed.

Next, a set of certain figures and/or words for advertising is printed on the inside of the OPP film (step S50). The printed figures and/or words include information or descriptions about stored items and a notice designed to attract public attention. As well known in the art, OPP resin has good transparency and good printability, so permits clear true-to-life print state.

The printed OPP film for the outer layer 4 is then attached to the outside of the PP textile for the base layer 3 by using PP resin applied thereto (step S60). Thereafter, the resultant three-layered material is supplied to a tubing machine (not shown) and the bag 1 is finished by using the tubing machine (step S70). In this step, the tubing machine forms an internal space for receiving contents, with open top and bottom, and forms lower and upper sealing portions 5 and 5' at lower and upper ends of the bag 1. Of course, the upper sealing portion 5' is formed after the bag 1 is filled with the contents such as grain or feed.

Typically, supplying the contents to the bag 1 is made by an automatic machine. At this time, a robot arm of the automatic machine grips the bag 1 to put the contents in the bag 1. However, since the conventional bag made of PE and/or OPP has low bending strength, the robot arm often fails to grip the bag or makes a mistake in operation. The present invention employs PP textile with high bending strength for the base layer 3, so that wrong operation of the automatic machine is reduced or eliminated. Also, since the bag 1 of the present invention is made of synthetic resin, a recycling to use again is possible.

When the bag 1 of the present invention contains powdered feed or feed full of fat or moisture, the sealing portions 5 and 5' of the bag 1 can be formed by thermal adhesion to block the ventilation of air. This makes possible the maintenance of nutritive value and freshness of feed, a decrease in manufacturing cost, and improvement in operation efficiency. Alternatively, depending on the contents, the sealing portions 5 and 5' can be formed by sewing.

While this invention has been particularly shown and described with reference to a preferred embodiment thereof, it will be understood by those skilled in the art that various changes in form and details may be made therein without departing from the spirit and scope of the invention as defined by the appended claims.

What is claimed is:

1. A synthetic resin bag for grain or feed, comprising:

an inner layer made of polypropylene textile woven in gauze;

a coating layer attached to an inside surface of the inner layer by using polypropylene resin applied thereto, wherein the coating layer is made of high-density polyethylene film; and an outer layer attached to an outside surface of the inner layer by using polypropylene resin applied thereto, wherein the outer layer is made of oriented polypropylene film mixed with non-slip material for raising coefficient of friction of the outer layer to 0.5 or more, and wherein the outer layer has a printed inside layer.

* * * * *